US010995637B2

(12) United States Patent
Patil et al.

(10) Patent No.: US 10,995,637 B2
(45) Date of Patent: May 4, 2021

(54) SWITCHING ROLLER FINGER FOLLOWER FOR VALVETRAIN

(71) Applicant: Eaton Intelligent Power Limited, Dublin (IE)

(72) Inventors: Santosh Patil, Hadapsar (IN); Matthew A. Vance, Kalamazoo, MI (US); Dale A. Stretch, Novi, MI (US); James E. McCarthy, Jr., Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/630,030

(22) PCT Filed: Jul. 10, 2018

(86) PCT No.: PCT/IB2018/055088
§ 371 (c)(1),
(2) Date: Jan. 10, 2020

(87) PCT Pub. No.: WO2019/012432
PCT Pub. Date: Jan. 17, 2019

(65) Prior Publication Data

US 2021/0010394 A1 Jan. 14, 2021

(30) Foreign Application Priority Data

Jul. 10, 2017 (IN) ..... 201711024296

(51) Int. Cl.
*F01L 1/18* (2006.01)
*F01L 1/053* (2006.01)
(Continued)

(52) U.S. Cl.
CPC ..... *F01L 1/185* (2013.01); *F01L 1/053* (2013.01); *F01L 1/24* (2013.01); *F01L 1/46* (2013.01);
(Continued)

(58) Field of Classification Search
CPC ... F01L 1/185; F01L 1/24; F01L 1/053; F01L 1/46; F01L 2001/467; F01L 2305/02
See application file for complete search history.

(56) References Cited

U.S. PATENT DOCUMENTS 7,318,402 B2 1/2008 Harman et al.
8,627,796 B2 * 1/2014 Harman ..... F01L 1/185 123/90.44
(Continued)

FOREIGN PATENT DOCUMENTS

CN 101595280 A 12/2009
CN 102373979 A 3/2012
(Continued)

OTHER PUBLICATIONS

International Search Report and Written Opinion for PCT/IB2018/055088, dated Nov. 12, 2018, pp. 1-11.

*Primary Examiner* — Zelalem Eshete
(74) *Attorney, Agent, or Firm* — Mei & Mark, LLP

(57) ABSTRACT

A rocker arm can comprise a forked outer arm assembly and a T-shaped inner arm assembly comprising an inner arm body comprising a valve side, a latch side, a bearing hole on the valve side, and a latch body on the latch side, the latch body comprising inner arm extensions extending away from the latch body. A pivot axle can connect the outer arm assembly to the inner arm assembly so that the inner arm assembly is configured to pivot with respect to the outer arm assembly. A latch assembly can comprise a latch configured to selectively extend to and retract from a latch seat on the latch body to selectively lock the inner arm assembly with respect to the outer arm assembly or unlock the inner arm assembly to pivot within the outer arm assembly.

22 Claims, 9 Drawing Sheets

(51) Int. Cl.
*F01L 1/24* (2006.01)
*F01L 1/46* (2006.01)

(52) U.S. Cl.
CPC ..... *F01L 2001/467* (2013.01); *F01L 2305/02* (2020.05)

(56) References Cited

U.S. PATENT DOCUMENTS

| | | | |
|---|---|---|---|
| 8,726,862 | B2 | 5/2014 | Zurface et al. |
| 8,752,513 | B2 | 6/2014 | Zurface et al. |
| 8,939,118 | B2 | 1/2015 | Stoody |
| 2011/0226208 | A1 | 9/2011 | Zurface et al. |
| 2012/0037107 | A1 | 2/2012 | Church |
| 2013/0000582 | A1 | 1/2013 | Church |
| 2014/0150745 | A1 | 6/2014 | Church |
| 2014/0290608 | A1 | 10/2014 | Radulescu |
| 2015/0377093 | A1 | 12/2015 | Church |
| 2017/0051643 | A1 | 2/2017 | Radulescu |
| 2017/0074128 | A1 | 3/2017 | Zurface et al. |
| 2018/0238198 | A1 | 8/2018 | Uckermark et al. |
| 2018/0306072 | A1 | 10/2018 | Brownell et al. |
| 2018/0320603 | A1 | 11/2018 | Vance et al. |
| 2019/0284971 | A1 | 9/2019 | Vance et al. |
| 2019/0309659 | A1 | 10/2019 | Vance |
| 2019/0309660 | A1 | 10/2019 | Vance |

FOREIGN PATENT DOCUMENTS

| | | | |
|---|---|---|---|
| CN | 102892977 | A | 1/2013 |
| CN | 103114884 | A | 5/2013 |
| CN | 104321503 | A | 1/2015 |
| EP | 2418359 | B1 | 9/2013 |
| WO | WO-2013/067506 | A1 | 5/2013 |
| WO | WO-2015/171688 | A1 | 11/2015 |
| WO | WO-2017/024249 | A1 | 2/2017 |
| WO | WO-2017/116917 | A1 | 7/2017 |
| WO | WO-2017/116918 | A1 | 7/2017 |
| WO | WO-2018/068041 | A1 | 4/2018 |
| WO | WO-2018/068046 | A1 | 4/2018 |

* cited by examiner

SWITCHING ROLLER FINGER FOLLOWER FOR VALVETRAIN

This is a § 371 National Stage entry of Patent Cooperation Treaty Application No. PCT/IB2018/055088, filed Jul. 10, 2018, and claims the benefit of Indian provisional application for patent 201711024296, filed Jul. 10, 2017, all of which are incorporated herein by reference.

FIELD

This application provides a switching roller finger follower for valvetrains with a T-shaped inner arm and alternative lost motion springs.

BACKGROUND

Current switching roller finger followers ("SRFFs") comprise an outer arm surrounding an inner arm. The outer arm can be designed for the actuation techniques of the valve to which the SRFF is attached and it can be designed with or without slider pads or rollers depending upon the number of overhead cams acting on the SRFF. The inner arm can comprise a U-shaped arm. A roller bearing can be mounted between the arms of the U-shaped arm. The bottom of the "U" can comprise a surface for interfacing with a latch mechanism for locking and unlocking the inner arm with respect to the outer arm. Numerous other designs are part of the prior art.

SUMMARY

The methods and devices disclosed herein improves the art by way of a T-shaped inner arm assembly, a hybrid T-shaped inner arm assembly, and alternative lost motion spring configurations.

A rocker arm comprises a forked outer arm assembly comprising a valve side, a pivot side, a pivot side body connecting a first outer arm and a second outer arm, and respective bearing holes in each of the first outer arm and the second outer arm. A T-shaped inner arm assembly comprises an inner arm body comprising a valve side, a latch side, a bearing hole on the valve side, and a latch body on the latch side, the latch body comprising inner arm extensions extending away from the latch body. A pivot axle connects the bearing holes of the first outer arm and the second outer arm with the bearing hole of the inner arm assembly so that the inner arm assembly is configured to pivot with respect to the outer arm assembly. A latch assembly is mounted in the pivot side body, the latch assembly comprising a latch configured to selectively extend to and retract from a latch seat on the latch body to selectively lock the inner arm assembly with respect to the outer arm assembly or unlock the inner arm assembly to pivot within the outer arm assembly.

An alternative rocker arm comprises a forked outer arm assembly comprising a valve side, a pivot side, a pivot side body connecting a first outer arm and a second outer arm, respective bearing holes in the valve side of each of the first outer arm and the second outer arm, and respective pockets through each of the first outer arm and the second outer arm, the respective pockets formed near the pivot side body. An inner arm assembly comprises a valve side, a latch side, a latch body on the latch side, a latch seat on the latch body, a first inner arm and a second inner arm extending away from the latch body to the valve side, respective bearing holes on the valve side of the first and second inner arms, and an inner arm extension bar comprising inner arm extensions extending through the pockets in the outer arm assembly. A pivot axle connects the bearing holes of the first outer arm and the second outer arm with the bearing holes of the first and second inner arms so that the inner arm assembly is configured to pivot with respect to the outer arm assembly. A latch assembly can be mounted in the pivot side body, the latch assembly comprising a latch configured to selectively extend to and retract from the latch seat to selectively lock the inner arm assembly with respect to the outer arm assembly or unlock the inner arm assembly to pivot within the outer arm assembly.

Additional objects and advantages will be set forth in part in the description which follows, and in part will be obvious from the description, or may be learned by practice of the disclosure, or may be learned by combining aspects of the embodiments with one another. The objects and advantages will also be realized and attained by means of the elements and combinations particularly pointed out in the appended claims.

It is to be understood that both the foregoing general description and the following detailed description are exemplary and explanatory.

DETAILED DESCRIPTION

Reference is made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1A:
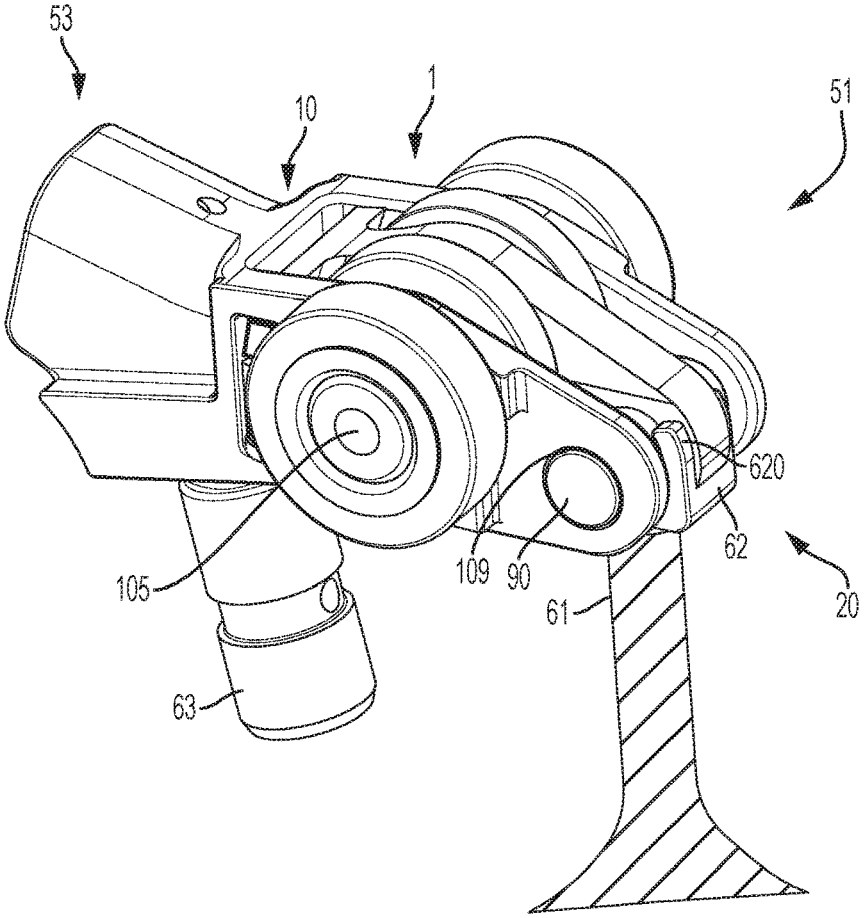
FIGS. 1A & 1B are views of a first rocker arm with a T-shaped inner arm assembly.
Figure 1B:
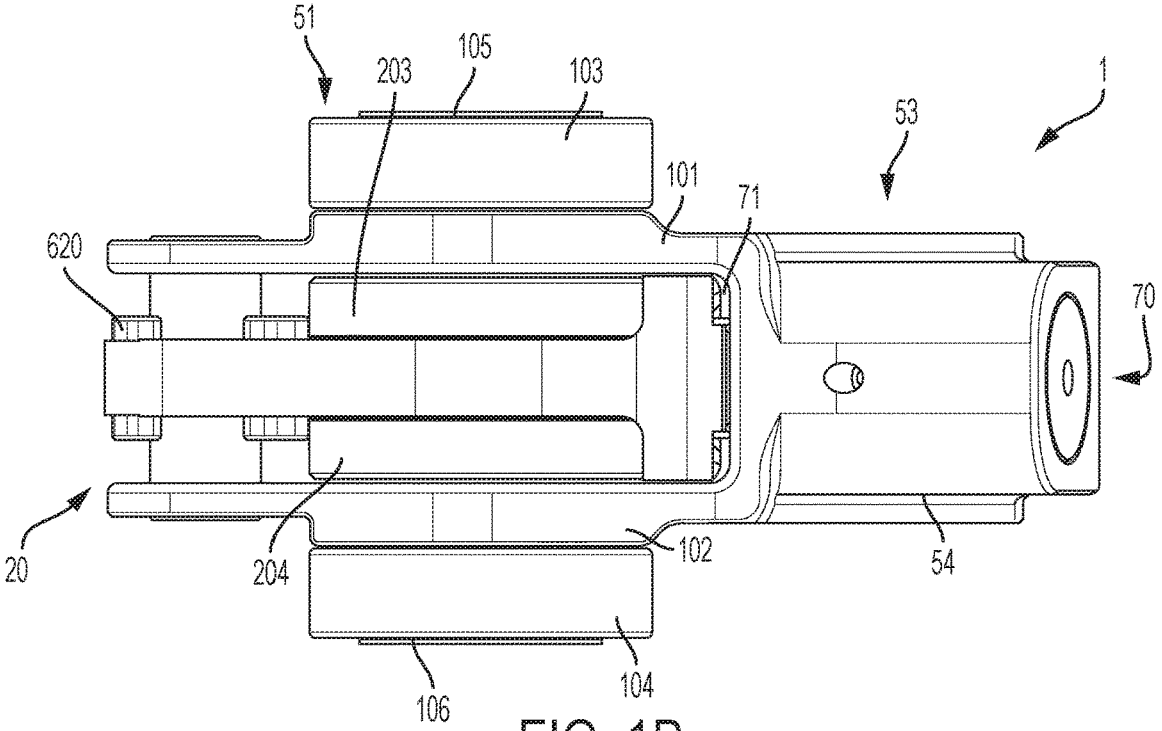

FIGS. 1A & 1B show a first rocker arm 1, or switching roller finger follower, with outer arms 101, 102 surrounding a T-shaped inner arm assembly 20. The T-shaped arm provides good stiffness, good stress profiles, and aligns forces on the rocker arm 1 with the line of action.

The outer arm assembly 10 can comprise a valve side 51 and a pivot side 53. A valve 61 can be installed on the valve side 51 on a pallet 64, 65 or e-foot (elephant foot) 62. A lash adjuster, such as a hydraulic lash adjuster 63 can be installed on the pivot side 53 and can connect to an oil control feed in an engine block. The hydraulic lash adjuster 63 can connect to an oil supply circuit to supply oil to a latch assembly 70. Latch assembly 70 can selectively project a latch 71 to lock the inner arm assembly 20 with respect to the outer arm assembly 10. Or, Latch assembly 70 can selectively retract the latch 71 in to the pivot-side body 54 so that the inner arm 20 can swing downward past the latch 71 when an overhead cam presses on the inner arm 20. Latch assembly can alternatively comprise an electrical latch assembly or mechanical latch assembly. Numerous variable valve actuation ("VVA") techniques can be enabled by designing an overhead cam, actuation timing, and the outer arm assembly 10 with respect to the inner arm assembly 20. Such techniques can comprise cylinder deactivation (CDA), engine braking, and early or late valve closing or opening techniques (EEVO, EEVC, EIVO, EIVC, LEVO, LEVC, LIVO, LIVC). Negative valve overlap (NVO) can be designed for by using a disclosed rocker arm on both the intake valve and the exhaust valve.

FIGS. 1A & 1B show the outer arms 101, 102 configured with cantilevered posts 105, 106 fitted with outside rollers 103, 104 for interfacing with rotating outer lobes of an overhead cam. And, inside rollers 203, 204 are mounted to inner arm assembly 20 and configured for interfacing with an inner lobe of the overhead cam. Bearing holes 109 are formed in the valve side 51 of the outer arms 101, 102 and inner arm bearing hole 209 is formed in the inner arm body 202. A pivot axle 90 spans the bearing holes 109 and inner arm bearing hole 209 to connect the inner arm assembly 20 to pivot with respect to the outer arm assembly 10. When the inner arm 20 and outer arms 101, 102 are latched together, the inner lobe of the overhead cam contacts the inside rollers 203, 204 and the rocker arm 1 moves as a unit to actuate the valve 61 (only the valve stem is shown in the figures, while the head of the valve is installed over an engine cylinder). A first valve lift profile can be achieved, such as a high or normal lift profile. When the inner arm 20 is unlatched from the outer arms, the inner cam lobe can push the inside rollers 203, 204 and inner arm 20 pivots with respect to the outer arms 101, 102. Several techniques such as comprising lost motion or lower lift profiles can be achieved. With outside rollers 103, 104, outer cam lobes can rotate against the outside rollers to achieve a second valve lift profile. If the outside rollers 103, 104 were omitted, an alternative second valve lift profile could be achieved. The second valve lift profiles can comprise zero lift profiles, and with appropriate cam lobe and roller designs, the high lift can be moved to the outer arm assembly 10 and the low lift can be moved to the inner arm assembly 20, among numerous alternative configurations.

Figure 2A:
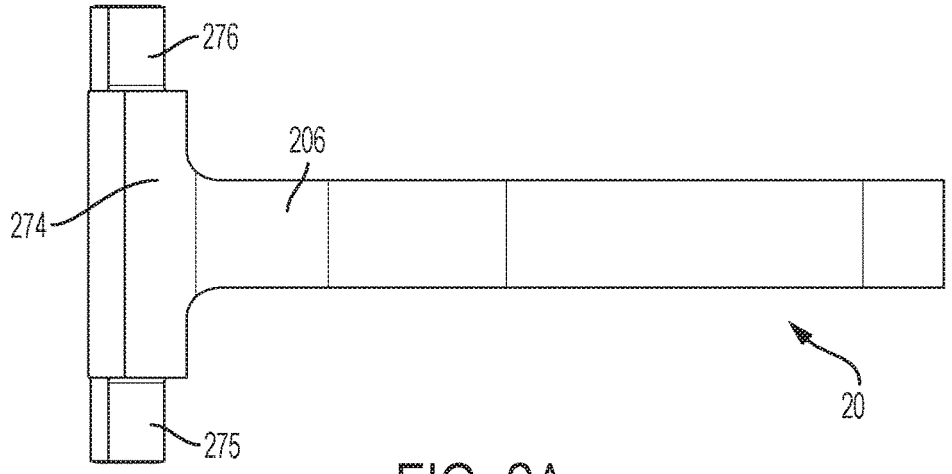
FIGS. 2A-2C are views of a T-shaped inner arm assembly.
Figure 2B:
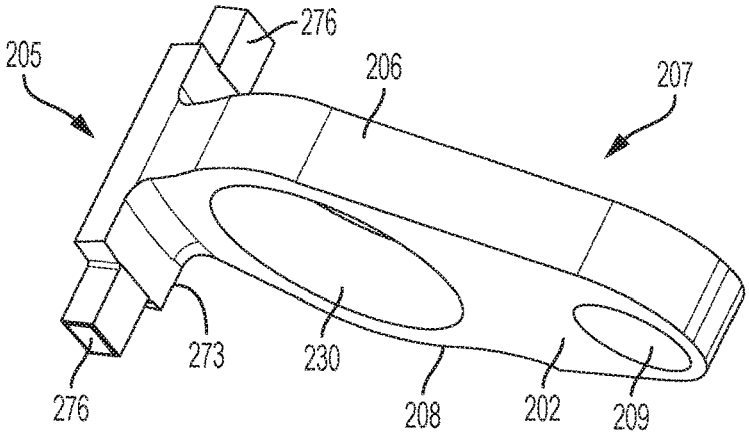
Figure 2C:
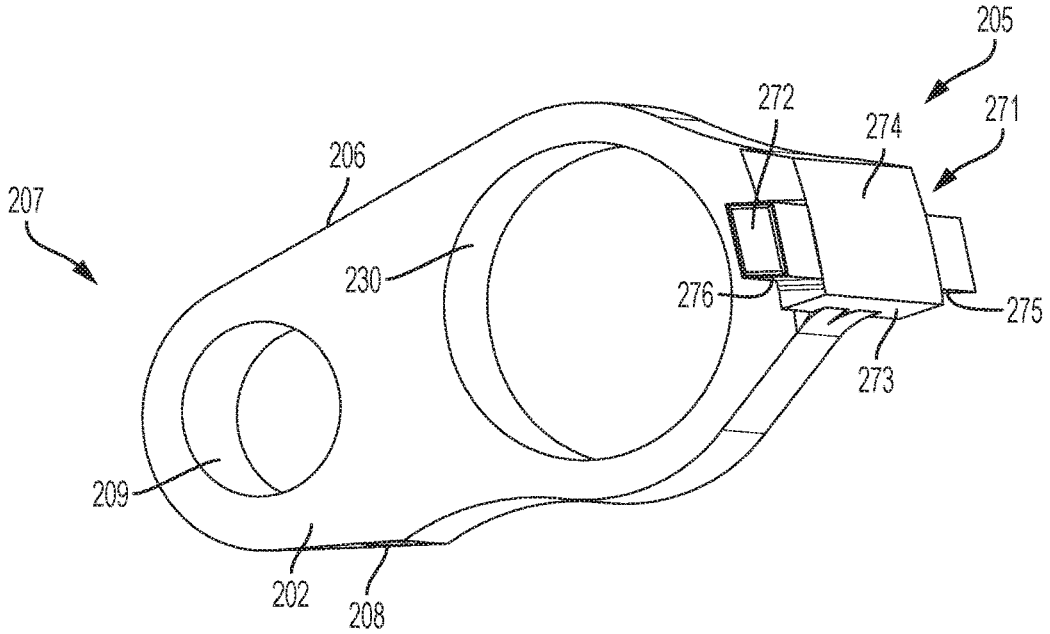
Figure 3A:
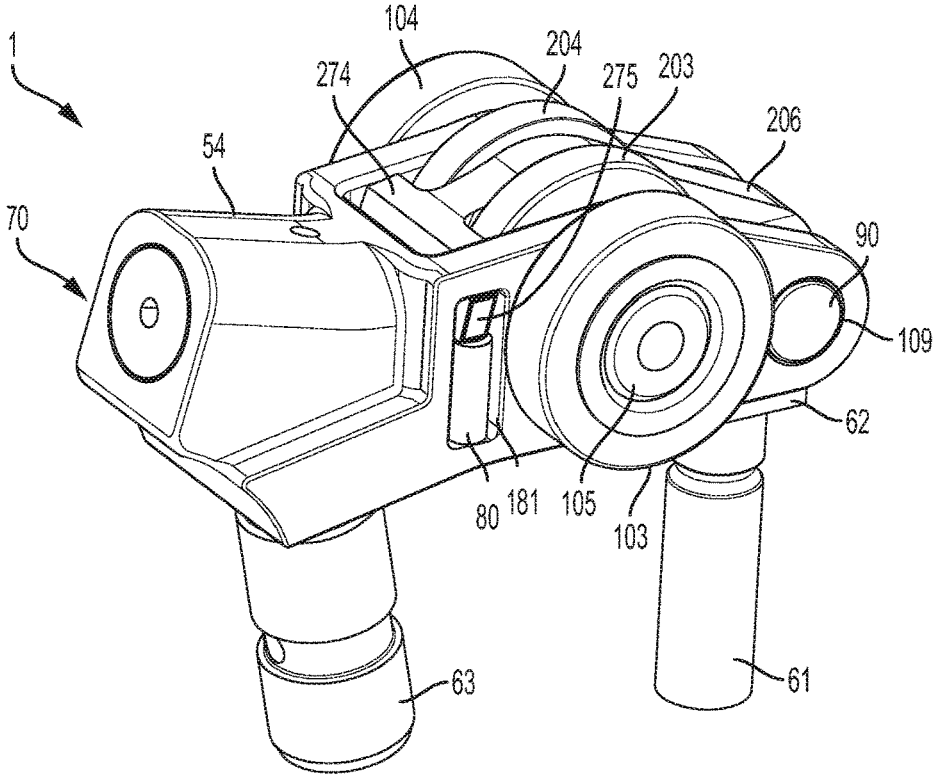
FIGS. 3A-3C are views of an alternate rocker arm comprising a telescopic spring assembly.
Figure 3B:
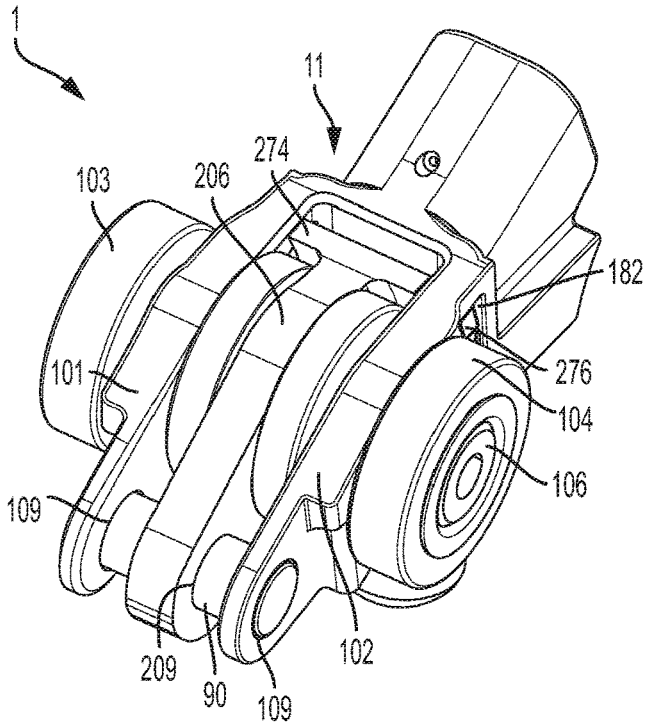
Figure 3C:
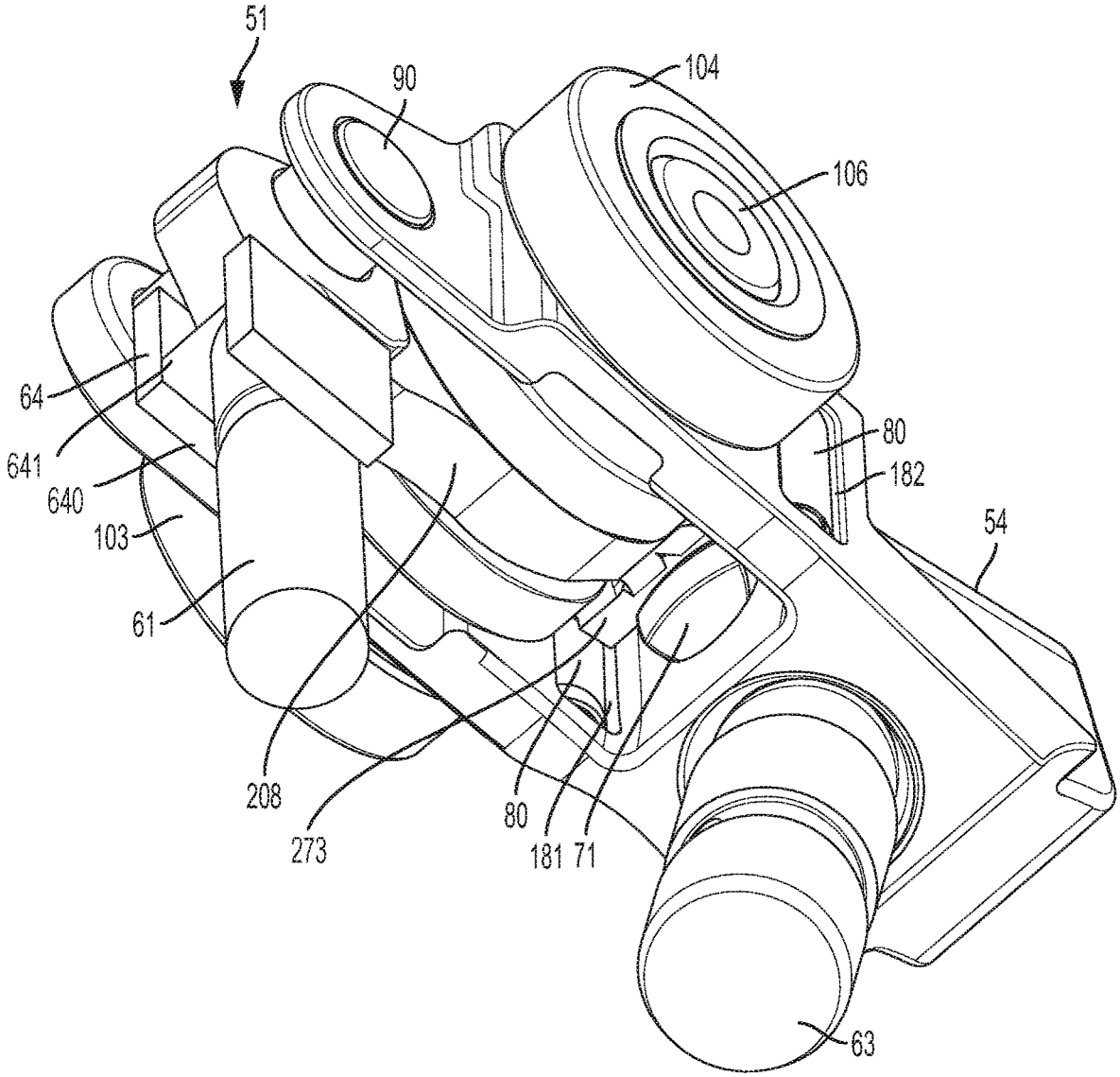

Turning to FIGS. 2A & 2B, a simplified inner arm assembly 20 having a T-shape is shown. An inner arm body 202 spans between the cam interface side 206 and the underside 208. The inner arm bearing hole 209 is on a valve side 207 of the inner arm assembly 20. A bearing axle hole 230 is closer to a latch side 205 of the inner arm assembly 20. The latch side 205 comprises inner arm extensions 271, 272 that can be stepped. A portion of the inner arm extensions 271, 272 can be formed as tee arms or spring arms 275, 276 configured to press on telescopic spring assemblies 80 configured to raise the inner arm assembly 20 with respect to the outer arm assembly 10 and configured to compress for such things as lost motion when the inner arm assembly 20 pivots with respect to the outer arm assembly 10. A latch seat step 273 can adjoin the inner arm extensions 271, 272 toward the underside 208.

The inner arm body 202 can be configured as a single slab of material instead of a double-sheet of material used for U-shaped inner arms. The thickness of the single slab can be chosen for good stiffness while still enabling simple manufacturing via such as stamping for forming the bearing holes 209, 230. It is possible to place inside rollers 203, 204 on each side of the inner arm body 202 to make contact with the overhead cam. Alternatively, it is possible to place a single one of the inside rollers 203, 204 on one single side of the inner arm body 202.

On the valve side 207, the configuration allows for easy installation of a valve pallet 64 on the inner arm assembly 20, a valve pallet 65 on the outer arm assembly 10, or an e-foot (elephant foot) 62 on the pivot axle 90. The e-foot 62 can comprise braces 620 configured to wrap around at least a portion of the pivot axle 90 and flank the valve side 207 of the inner arm assembly 20 so that the e-foot can swivel slightly during rocker arm motion yet seat the valve 61.

On the latch side 205, the latch interface comprises a latch seat step 273. The design aligns the line of force at the latch 71 directly in line with the beam of the inner arm body 202. The latch arm body 274 can be sized for strength & ease of manufacture.

Several benefits of the T-shaped inner arm assembly 20 inure. The T-shaped inner arm is an excellent structure that is stiff due to its T-shaped geometry. It exhibits low moment in a side-to-side direction since all forces from the latch pin 71 to the valve 61 are in the same line of motion. The inner arm assembly 20 has lower stresses over current technology. It is easier to machine a latch pin surface (latch seat step 273) on the T-shaped arm than on a U-shaped arm. The T-shaped arm can be consider a single flange arm.

When compared to U-shaped arm designs, the T-shaped arm is lighter, simpler, and stiffer, with geometrical similarities to an I-beam. A U-shaped arm can have a wider roller between the arms of the "U," and the arms can be thinner. However, additively, the single body 202 of the T-shaped inner arm assembly 20 can be thicker than either arm of the U-shaped arm, but thinner than the sum of the U-shaped arm thicknesses.

Figure 7:
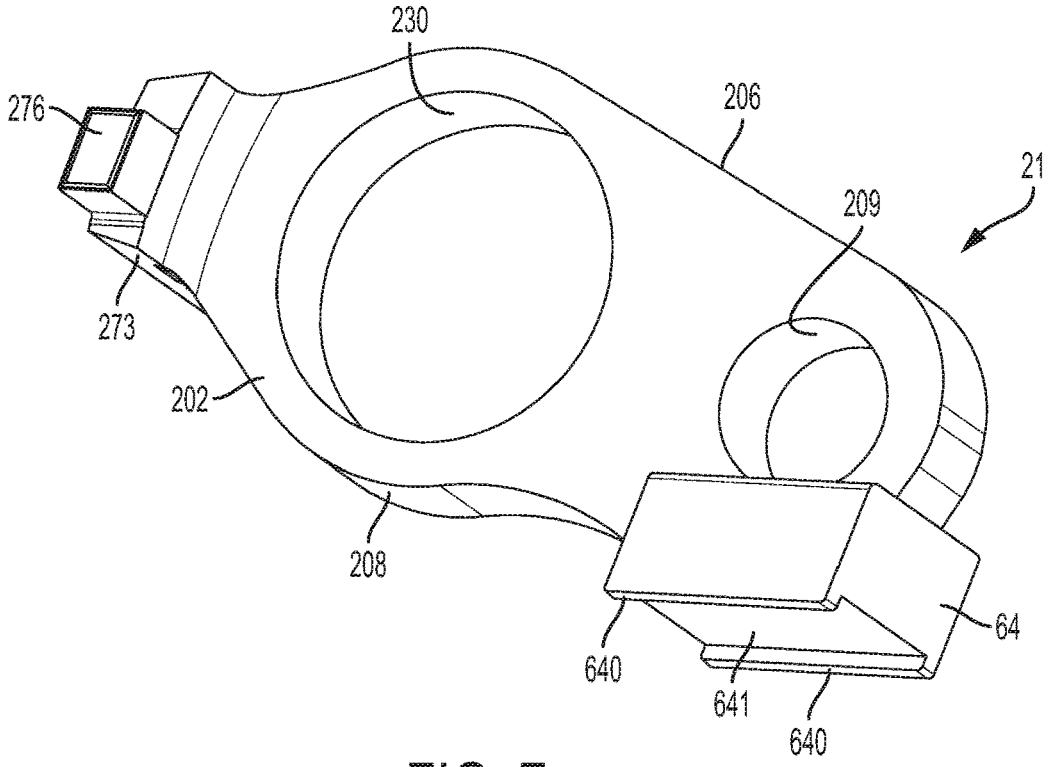
FIG. 7 is a view of an alternative T-shaped inner arm assembly.

As shown in FIG. 7, T-shaped inner arm assembly 21 can be equipped with a pallet 64, guides 640, and a valve seat 641 to guide valve 61.

The rocker arm 1 is configured with a telescopic spring assembly 80 in pockets 181, 182 in the outer arms 101, 102. The telescopic spring assembly 80 can comprise a compression spring 81 biased to push the spring arms 275, 276 towards an overhead cam system. A coil spring 81 is shown, though other springs such as leaf springs, wave springs, or a wrapped strip steel telescopic spring and the like can be substituted if the force and dimension criteria can be accomplished. The dimensions of the spring arms 275, 276 can be selected to provide a particular lash or lift above the latch 71 and the dimensions can also be selected to take up an amount of the rectangular pockets 181, 182 in favor of controlling the compression force on the compression spring 81. The pockets 181, 182 can be rectangular and can be sized to guide the spring arms 275, 276 and to house a retainer 82 for the compression spring 81. The size and shape of the pockets 181, 182 can be chosen to control the amount of lost motion provided by the compression springs 81 and the amount of valve motion for the second valve lift profile.

Figure 4A:
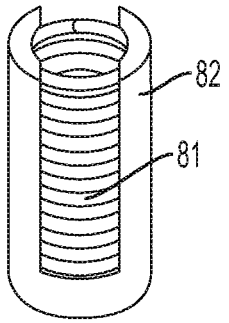
FIGS. 4A & 4B are views of a first telescopic spring assembly.
Figure 4B:
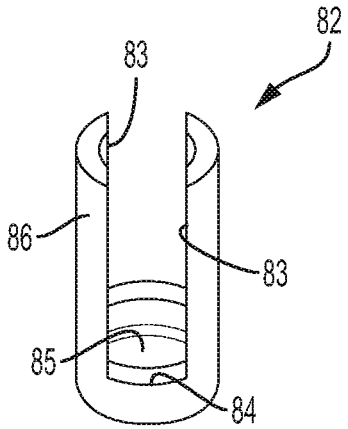

The retainers 82 can be arranged to guide the compression spring and the spring arms 275, 276 of the inner arm extensions 271, 272. Turning to FIG. 4A, an assembled view shows the spring 81 within the retainer 82. Slots 83 can receive respective spring arms 275, 276 and the slots 83 can be shaped to guide the spring arm as it travels. Two slots 83 are illustrated, however a single slot in a tubular cupping guide is another alternative. As shown in FIG. 4B, a spring seat 85 can be formed in the bottom of the retainer 82, with a rim 84 included to control the base of the spring 81. The retainer can comprise cupping guides 86 that cup the spring 81. With this design, the retainer can be fitted, as by press fitting, within respective pockets 181, 182. The spring 81 can retract and expand in response to motion by inner arm assembly 20.

Figure 5:
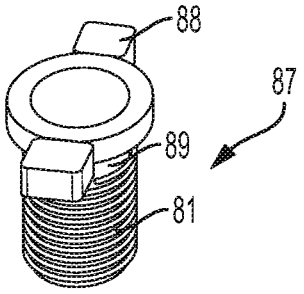
FIG. 5 is an exploded view of a second telescopic spring assembly.
Figure 5:
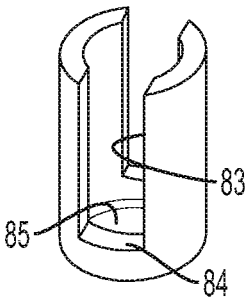
Figure 6:
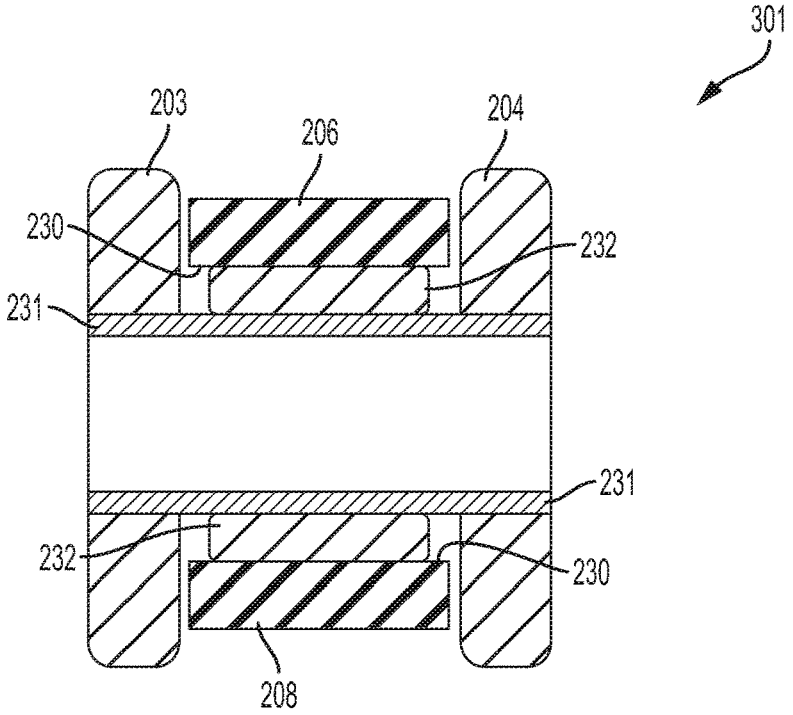
FIG. 6 is a view of a bearing assembly for an inner arm assembly.

Turning to the alternative of FIG. 5, a flange 87 can be included. Wing guides 88 can be included to reciprocate in the slots 83. The spring arms 275, 276 can continue to travel in the slots 83, but the spring arms 275, 276 press on the flange 87 instead of directly on the spring 81. A portion of the spring can wrap around the flange body, and the height of the flange body can be adjusted to control the extent of inner arm assembly travel with respect to the outer arm assembly.

Other torsion spring designs can comprise stamped retainers either mounter on outer posts on the pivot side 53 or the valve side 51. The proposed architecture of compression spring 81 and telescopic spring assembly 80 has several advantages. It fits into a very small space. It eliminates a need of heavy outer arm posts and retainers for spring mountings. It reduces part count. It reduces the weight of the rocker arm assembly. The compression spring 81 has a high fatigue life because the coils are equally loaded in the compression spring.

Further with respect to the inner arm assemblies 20 & 21, it is possible to provide a bearing assembly 301 comprising a single center bearing axle 231 in the bearing axle hole 230. Optionally, a row of rollers or needles 232 can be fitted around the bearing axle 231 and within the bearing axle hole 230. The inside rollers 203, 204 can be fitted to the bearing axle 231, as by press fitting. The low cost design permits ease of manufacturing, use of a single bearing axle, and the press fit enables a stiff bearing assembly 301.

Figure 8:
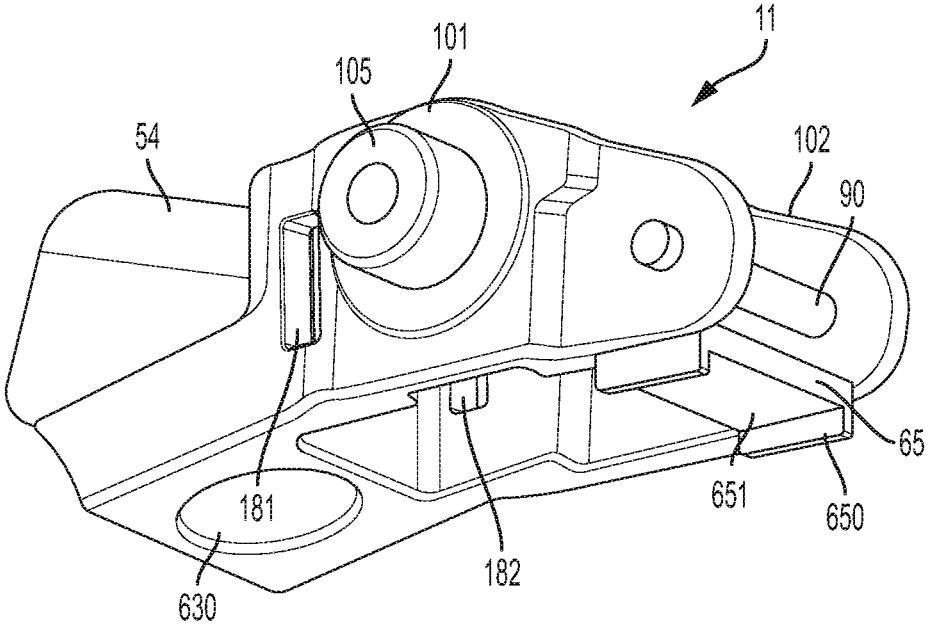
FIG. 8 is a view of an alternative outer arm assembly.

In FIG. 8, a rocker arm 2 comprises an alternative outer arm assembly 11 with a pallet 65 mounted to the valve side 51 of outer arms 101, 102. The pallet 65 can be configured as a travel stop to limit the pivoting of inner arm assembly 20 on pivot axle 90 with respect to outer arm assembly 11. The pivoting can be limited in the other direction by the spring arms 275, 276. This pallet 65 design modification will also help to reduce pivot axle 90 diameter. Additional guides 650 can be included to guide the valve 61 as its stem slides on valve seat 651.

FIG. 8 also shows the cantilevered post 105 for the outside roller 103. Various bushing and cap alternatives can be used to secure the outside rollers 103, 104 to the cantilevered posts 105, 106. A socket 630 for the hydraulic lash adjuster 63 is also shown.

A rocker arm comprises a forked outer arm assembly 10, 11 comprising a valve side 51, a pivot side 53, a pivot side body 54 connecting a first outer arm 101 and a second outer arm 102, and respective bearing holes 109 in each of the first outer arm and the second outer arm. A T-shaped inner arm assembly 20, 21 comprises an inner arm body 202 comprising a valve side 207, a latch side 205, a bearing hole 209 on the valve side, and a latch body 274 on the latch side, the latch body comprising inner arm extensions 271, 272 extending away from the latch body 274. A pivot axle 90 connects the bearing holes 109 of the first outer arm and the second outer arm with the bearing hole 209 of the inner arm assembly 20, 21 so that the inner arm assembly is configured to pivot with respect to the outer arm assembly 10, 11. A latch assembly 70 is mounted in the pivot side body 54, the latch assembly comprising a latch 71 configured to selectively extend to and retract from a latch seat 273 on the latch body 274 to selectively lock the inner arm assembly 20, 21 with respect to the outer arm assembly 10, 11 or unlock the inner arm assembly to pivot within the outer arm assembly.

A bearing axle hole 230 can be between the latch body 274 and the bearing hole 209. A bearing axle 231 can be in the bearing axle hole 230. At least one bearing (one of inside rollers 203, 204) can be fitted to the bearing axle 231 for rotation thereon. The bearing axle 231 extends through the bearing axle hole 230 such that ends of the bearing axle protrude out from the bearing axle hole. The at least one bearing (one of inside rollers 203, 204) fitted to the bearing axle for rotation thereon comprises two bearings (both of inside rollers 203, 204) respectively fitted to the protruding ends of the bearing axle for rotation thereon.

A first outside roller 103 can be mounted on the first outer arm 101 and a second outside roller 104 can be mounted on the second outside arm 102.

An elephant foot 62 can be coupled to the pivot axle 90, the elephant foot comprising braces 620 flanking the valve side 207 of the inner arm assembly 20. Or, a pallet 64 can becoupled to the valve side 207 of the inner arm assembly 21, the pallet configured to seat a valve stem. Or, a pallet 65 can be coupled across the valve side 51 of the outer arm assembly 11, the pallet configured to seat a valve stem.

The latch assembly 70 can comprise a hydraulic latch assembly, as an alternative to mechanical, electrical, or electromechanical latch assemblies. Pivot body 54 can further comprise a socket 630 for receiving a hydraulic lash adjuster 63, the socket 630 in fluid communication with the latch assembly 70.

The first outer arm 101 and the second outer arm 102 are straight, and the inner arm body 202 is parallel between the first outer arm and the second outer arm.

The respective pockets 181 can be formed in the first outer arm 101 and in the second outer arm 102. The inner arm extensions 271, 272 extend into the respective pockets 181. Respective telescopic spring assemblies 80 can be seated in the respective pockets 181. Telescopic spring assemblies 80 can be configured to bias the inner arm extensions 271, 272 such that the latch body 274 is above the latch 71. Inner arm extensions 271, 272 can be stepped to form respective spring arms 275, 276 configured to compress the respective telescopic spring assemblies 80 when an overhead cam presses on the inner arm assembly 20, 21. The step sizes can be selected to control the travel of the inner arm assembly 20, 21 or extent of spring compression within the pockets, among others. Each of the respective telescopic spring assemblies 80 can comprise a compression spring 81, and a retainer 82 configured with cupping guides 86 and a spring seat 85 to house the compression spring 81. The cupping guides 86 can be separated by at least one slot 83 or two slots 83. The at least one slot 83 is configured to guide one of the inner arm extensions 271 or 272. A flange 87 can be between the compression spring 81 and the one of the inner arm extensions 271 or 272. The flange can comprise at least one wing guide 88 to travel in the at least one slot 83. The flange 87 can comprise a flange body 89 extending in to the retainer 82. A portion of the compression spring 81 can optionally wrap around the flange body 89.

Benefits of the T-shaped inner arm assemblies 20, 21 can be applied to U-shaped inner arm assemblies to form a hybrid T-shaped inner arm assembly 22. Then, an outer arm assembly 12 comprising pivot side 530 features of outer springs 801, 802 can be used. A hybrid T-shape can be formed by adding an optional set of drop arms 2778, 2788 to the U-shaped inner arms 2770, 2780, and mounting an inner arm extension bar 2710 to the drop arms. The extension bar 2710 can be directly mounted to the inner arms

1010, 1020, as an alternative, thus omitting the drop arms 2778, 2788. A variable valve lift rocker arm 3 is formed with torsion springs 801, 802 mounted externally to the outer arms 1010, 1020. Benefits inure, such as high stiffness in the latched and unlatched conditions, less mass forming a moment of inertia over the valve, a simplified outer arm design for manufacture, a simplified torsion spring design, low stresses in the outer arms, and low manufacturing costs.

Outer arm assembly 12 comprises a pocket 1018 on each side through which inner arm extension bar 2710 extends spring arms 2760, 2750 and end caps 2782, 2781. Alternatives comprise grooves or notches or dog-bone configurations to retain extended arms 805, 806 of the outer springs 801, 802.

The rocker arm 3 can be made thinner by moving the torsion springs 801, 802 to external mountings while maintaining rocker arm stiffness. The rectangular pockets 181, 182 for telescopic spring assembly 80 can be substituted, as drawn, with ovular pockets 1018 that permit spring arms 2760, 2750 to pivot therein. By locating the springs 801, 802 outside the outer arms 1010, 1020, the outer arms 1010, 1020 can be straight instead of bent or stepped around the latch arm body 274 and inside rollers 203, 204. This reduces transverse direction bending deflection and bending stress. Outer arms 1010, 1020 retain high section modulus and a low stress value. Ovular pocket 1018 can be other shapes than oval (such as arc or rectangular) depending on the desired motion of the inner arm assembly 22 with respect to the outer arm assembly 12. Pocket 1018 is strategically placed about a neutral bending axis of the outer arm. The existence of material above and below of the ovular pocket 108 is effective to resist outer arm deflection and stiffness reduction.

Outer springs 801, 802 can be mounted on posts on the pivot side body 540 and caps 809 can be used to secure the springs in place. Pins 1012 can be used to bias the outer springs 801, 802 at first ends. A shelf 1013 can be used alternatively or additionally for directing the spring forces. Coils 803, 804 can terminate with extended legs 805, 806 biased against the spring arms 2760, 2750. With the close proximity of the spring legs 2760, 2750 to the coils 803, 804, the spring legs can be made short. The outer springs 801, 802 can be designed with low stress and low fatigue.

Figure 9A:
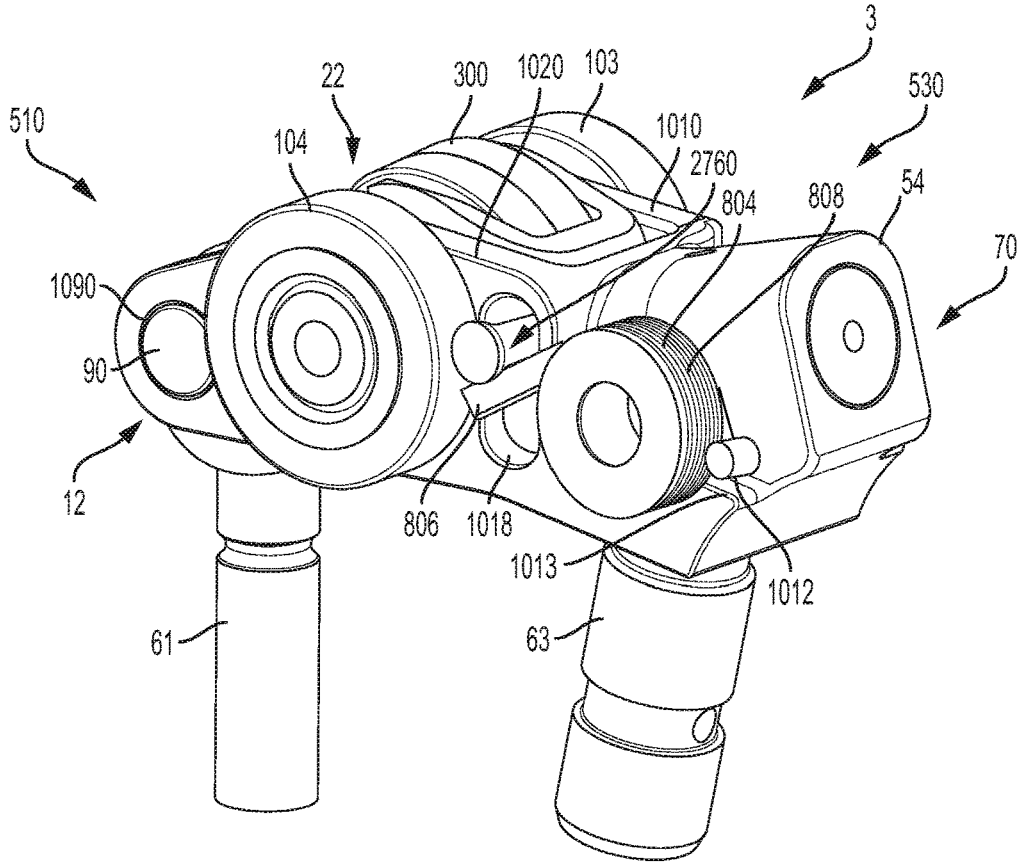
FIGS. 9A-9B are views of a rocker arm comprising straight outer arms and a hybrid T-shaped inner arm assembly.
Figure 9B:
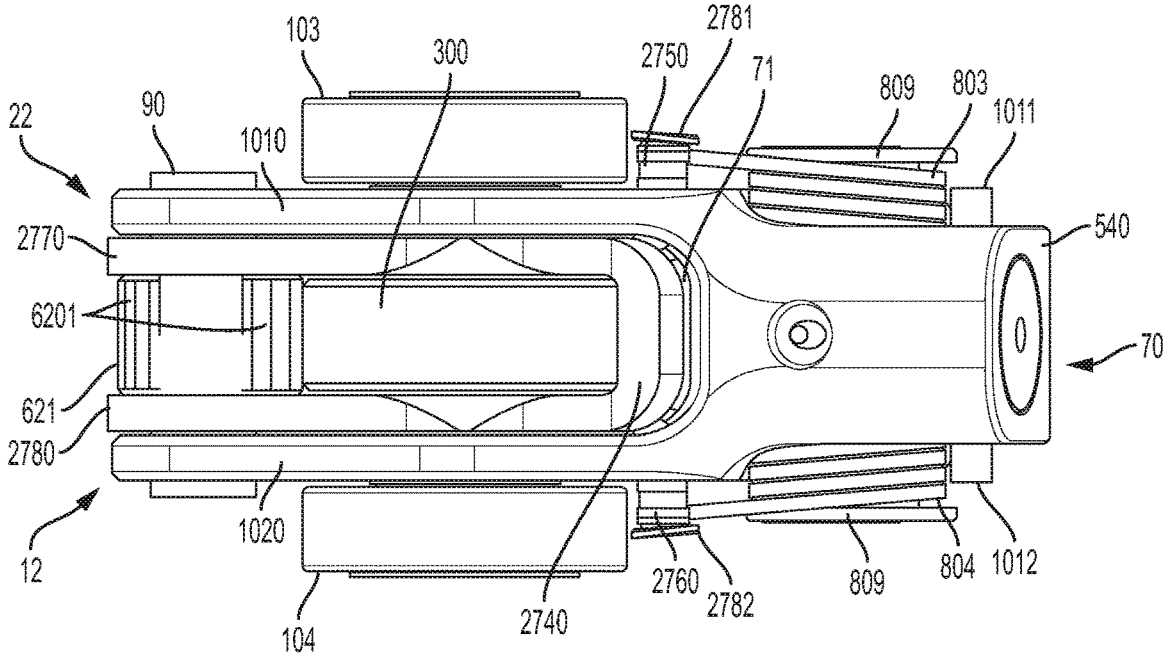

The straight outer arms 1010, 1020 can be seen in FIG. 9B, where the U-shaped inner arms 2770, 2780 are also straight. The straight design reduces the overall width of the rocker arm assembly 3. This will reduce bending stress about the roller axis and will keep high stiffness of the rocker arm 3.

The pivot axle 90 can be embraced by e-foot braces 6201 that wrap around the pivot axle 90 to enable the e-foot to swivel thereon. Stem of valve 61 can be seated on the e-foot 621. The e-foot can be positioned between the valve sides 2070 of the inner arms 2770, 2780.

Figure 10A:
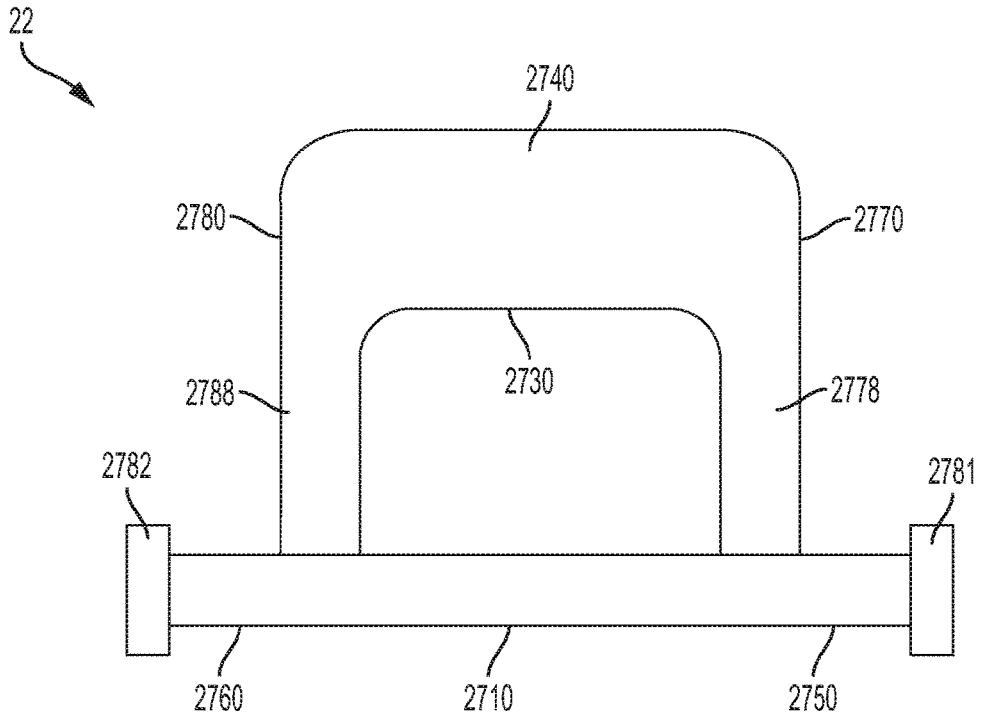
FIGS. 10A & 10B are views of a hybrid T-shaped inner arm assembly.
Figure 10B:
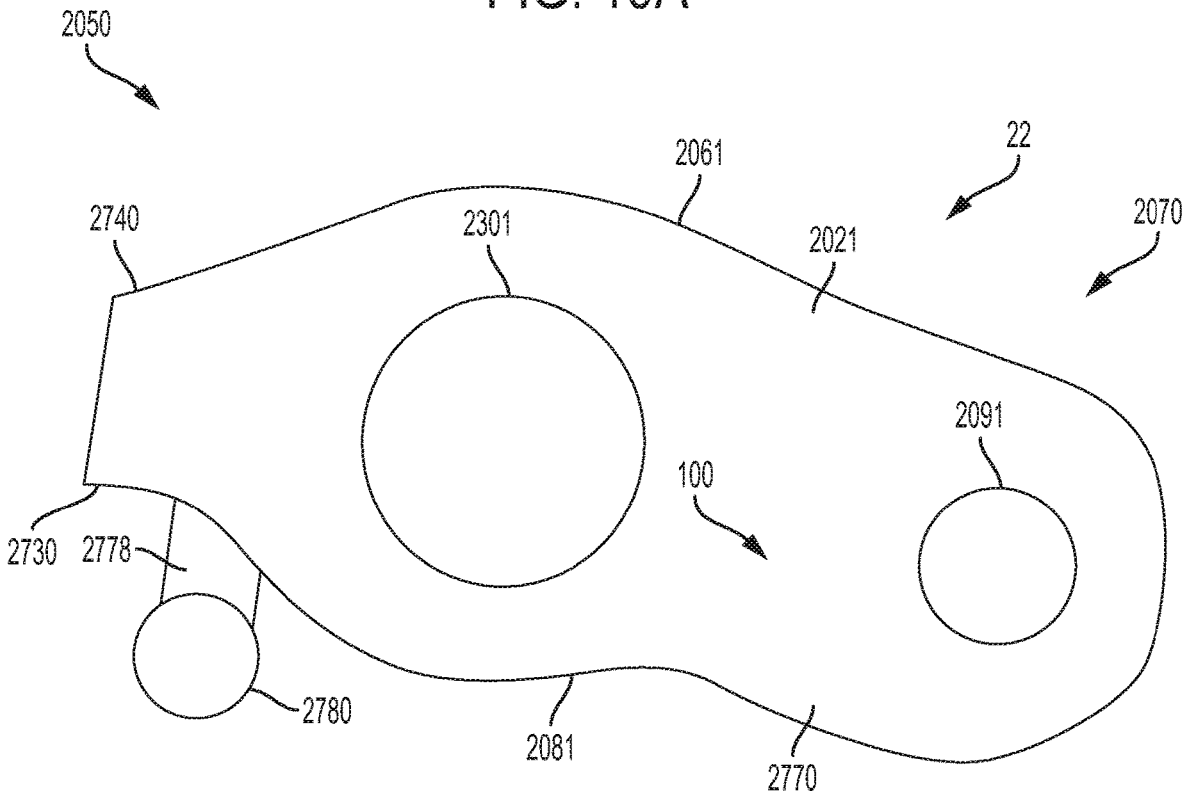

FIGS. 10A & 10B are views of the hybrid T-shaped inner arm assembly 22. The U-shaped inner arm assembly 22 has parallel arms 2770, 2780 with a connecting latch arm body 2740 on a latch side 2050. The latch seat 2730 can interface with the latch 71 of the latch assembly 70. Drop arms 2778, 2788 are recessed from the latch seat 2730 in this example and can be behind the plane of the latch arm body 2740 so that inner arm extension bar 2710 does not interfere with latching and unlatching. Two bearing axle holes, including bearing axle hole 2301, are positioned in respective bodies, including inner arm body 2021, so that a bearing axle can be mounted with a roller bearing 300 and option needle bearings. Two pivot axle bearing holes, including pivot axle bearing hole 2091, are included in valve ends 2070 of the inner arm assembly 22 so that a pivot axle 90 can join the inner arm assembly 22 to pivot with respect to the outer arm assembly 12.

An alternative rocker arm comprises a forked outer arm assembly 12 comprising a valve side 510, a pivot side 530, a pivot side body 540 connecting a first outer arm 1010 and a second outer arm 1020. Respective bearing holes 1090 are in the valve side 510 of each of the first outer arm and the second outer arm. Respective pockets through each of the first outer arm and the second outer arm, the respective pockets 1018 are formed near the pivot side body 540. An inner arm assembly 22 comprises a valve side 2070, a latch side 2050, a latch body 2740 on the latch side, a latch seat 2730 on the latch body, a first inner arm 2770 and a second inner arm 2780 extending away from the latch body 2740 to the valve side 2070. Respective bearing holes 2091 are on the valve side 2070 of the first and second inner arms 2770, 2780. An inner arm extension bar 2710 comprises inner arm extensions 2760, 2750 extending through the pockets 1018 in the outer arm assembly 12. A pivot axle 90 connects the bearing holes 1090 of the first outer arm and the second outer arm with the bearing holes 2090 of the first and second inner arms 2770, 2780 so that the inner arm assembly 22 is configured to pivot with respect to the outer arm assembly 12. A latch assembly 70 can be mounted in the pivot side body 540. The latch assembly 70 can comprise a latch 71 configured to selectively extend to and retract from the latch seat 2730 to selectively lock the inner arm assembly 22 with respect to the outer arm assembly 12 or unlock the inner arm assembly to pivot within the outer arm assembly.

Respective bearing axle holes 2301 can be formed in each of the first and second inner arms 2770, 2780 between the latch body 2740 and the respective bearing holes. A bearing axle can be fitted to the respective bearing axle holes 2301. A bearing 300 can be fitted to the bearing axle for rotation thereon.

An elephant foot 62 can be coupled to the pivot axle 90. The elephant foot 62 can be configured to seat a valve stem.

The latch assembly 70 can comprises a hydraulic latch assembly. The pivot body 540 can further comprise a socket for receiving a hydraulic lash adjuster. The socket can be in fluid communication with the latch assembly 70.

A first outside roller 103 can be mounted on the first outer arm 1010 and a second outside roller 103 can be mounted on the second outside arm 1020. The first outer arm 1010 and the second outer arm 1020 can be straight. The first and second inner arms 2770, 2780 can be parallel between the first outer arm and the second outer arm.

A torsion spring (outer springs 801, 802) can be mounted to the pivot side body 540. The torsion spring can comprise a first end 807 or 808 biased against a pin 1012 or a shelf 1013 on the pivot side body 540. The torsion spring can comprise an extended leg 805, 806 biased against one of the inner arm extensions 2760, 2750 extending through one of the pockets 1018 in the outer arm assembly 12. Torsion spring can comprise a coil 803 or 804 mounted to the pivot side body 540, with the coil 803 or 804 between the first end of the torsion spring and the extended leg 805 or 806.

The inner arm extensions 2760, 2750 extending through the pockets 1018 in the outer arm assembly 12 can comprise respective arm limits 2782, 2781 configured to restrict the extended spring legs 805 or 806. Alternatives and additions comprise dog-bone shapes and notches, among others.

Respective drop arms 2778, 2788 can extend down from the first and second inner arms 2770, 2780. Drop arms 2778, 2788 can span between the first and second inner arms and the inner arm extension bar 2710.

Other implementations will be apparent to those skilled in the art from consideration of the specification and practice of the examples disclosed herein.

What is claimed is:

1. A rocker arm, comprising:

a forked outer arm assembly comprising a valve side, a pivot side, a pivot side body connecting a first outer arm and a second outer arm, and respective bearing holes in each of the first outer arm and the second outer arm;

a T-shaped inner arm assembly comprising an inner arm body comprising a valve side, a latch side, a bearing hole on the valve side, and a latch body on the latch side, the latch body comprising inner arm extensions extending away from the latch body;

a pivot axle connecting the bearing holes of the first outer arm and the second outer arm with the bearing hole of the inner arm assembly so that the inner arm assembly is configured to pivot with respect to the outer arm assembly; and a latch assembly mounted in the pivot side body, the latch assembly comprising a latch configured to selectively extend to and retract from a latch seat on the latch body to selectively lock the inner arm assembly with respect to the outer arm assembly or unlock the inner arm assembly to pivot within the outer arm assembly.

2. The rocker arm of claim 1, further comprising:

a bearing axle hole between the latch body and the bearing hole;

a bearing axle in the bearing axle hole; and at least one bearing fitted to the bearing axle for rotation thereon.

3. The rocker arm of claim 2, wherein the bearing axle extends through the bearing axle hole to such that ends of the bearing axle protrude out from the bearing axle hole, and wherein the at least one bearing fitted to the bearing axle for rotation thereon comprises two bearings respectively fitted to the protruding ends of the bearing axle for rotation thereon.

4. The rocker arm of of claim 1, further comprising a first outside roller mounted on the first outer arm and a second outside roller mounted on the second outside arm.

5. The rocker arm of claim 1, further comprising an elephant foot coupled to the pivot axle, the elephant foot comprising braces flanking the valve side of the inner arm assembly.

6. The rocker arm of claim 1, further comprising a pallet coupled to the valve side of the inner arm assembly, the pallet configured to seat a valve stem.

7. The rocker arm of claim 1, further comprising a pallet coupled across the valve side of the outer arm assembly, the pallet configured to seat a valve stem.

8. The rocker arm of claim 1, wherein the latch assembly comprises a hydraulic latch assembly, and wherein the pivot body further comprises a socket for receiving a hydraulic lash adjuster, the socket in fluid communication with the latch assembly.

9. The rocker arm of claim 1, wherein the first outer arm and the second outer arm are straight, and wherein the inner arm body is parallel between the first outer arm and the second outer arm.

10. The rocker arm of claim 1, further comprising respective pockets in the first outer arm and in the second outer arm, wherein the inner arm extensions extend into the respective pockets.

11. The rocker arm of claim 10, further comprising respective telescopic spring assemblies seated in the respective pockets, the telescopic spring assemblies configured to bias the inner arm extensions such that the latch body is above the latch.

12. The rocker arm of claim 11, wherein the inner arm extensions are stepped to form respective spring arms configured to compress the respective telescopic spring assemblies when an overhead cam presses on the inner arm assembly.

13. The rocker arm of claim 11, wherein each of the respective telescopic spring assemblies comprise:

a compression spring; and a retainer configured with cupping guides and a spring seat to house the compression spring, wherein the cupping guides are separated by at least one slot, and wherein the at least one slot is configured to guide one of the inner arm extensions.

14. The rocker arm of claim 13, further comprising a flange between the compression spring and the one of the inner arm extensions, the flange comprising at least one wing guide to travel in the at least one slot.

15. The rocker arm of claim 14, wherein the flange comprises a flange body extending in to the retainer, and wherein a portion of the compression spring wraps around the flange body.

16. A rocker arm, comprising:

a forked outer arm assembly comprising a valve side, a pivot side, a pivot side body connecting a first outer arm and a second outer arm, respective bearing holes in the valve side of each of the first outer arm and the second outer arm, and respective pockets through each of the first outer arm and the second outer arm, the respective pockets formed near the pivot side body;

an inner arm assembly comprising a valve side, a latch side, a latch body on the latch side, a latch seat on the latch body, a first inner arm and a second inner arm extending away from the latch body to the valve side, respective bearing holes on the valve side of the first and second inner arms, an inner arm extension bar comprising inner arm extensions extending through the pockets in the outer arm assembly, and respective drop arms extending down from the first and second inner arms, wherein the drop arms span between the first and second inner arms and the inner arm extension bar;

a pivot axle connecting the bearing holes of the first outer arm and the second outer arm with the bearing holes of the first and second inner arms so that the inner arm assembly is configured to pivot with respect to the outer arm assembly; and a latch assembly mounted in the pivot side body, the latch assembly comprising a latch configured to selectively extend to and retract from the latch seat to selectively lock the inner arm assembly with respect to the outer arm assembly or unlock the inner arm assembly to pivot within the outer arm assembly.

17. The rocker arm of claim 16, further comprising:

respective bearing axle holes in each of the first and second inner arms between the latch body and the respective bearing holes;

a bearing axle fitted to the respective bearing axle holes; and a bearing fitted to the bearing axle for rotation thereon.

18. The rocker arm of claim 16, further comprising a first outside roller mounted on the first outer arm and a second outside roller mounted on the second outside arm.

19. The rocker arm of claim 16, further comprising an elephant foot coupled to the pivot axle, the elephant foot configured to seat a valve stem.

20. The rocker arm of claim 16, further comprising a torsion spring mounted to the pivot side body, the torsion spring comprising a first end biased against a pin or shelf on the pivot side body, and the torsion spring comprising an extended leg biased against one of the inner arm extensions extending through one of the pockets in the outer arm assembly.

21. The rocker arm of claim 20, wherein the torsion spring comprises a coil mounted to the pivot side body, the coil between the first end and the extended leg.

22. The rocker arm of claim 20, wherein the inner arm extensions extending through the pockets in the outer arm assembly comprise respective arm limits configured to restrict the extended spring legs.

* * * * *